US011446545B2

(12) United States Patent
Polygerinos et al.

(10) Patent No.: US 11,446,545 B2
(45) Date of Patent: Sep. 20, 2022

(54) SOFT ROBOTIC HAPTIC INTERFACE WITH VARIABLE STIFFNESS FOR REHABILITATION OF SENSORIMOTOR HAND FUNCTION

(71) Applicants: Panagiotis Polygerinos, Gilbert, AZ (US); Frederick Sebastian, Tempe, AZ (US); Qiushi Fu, Chandler, AZ (US); Marco Santello, Gilbert, AZ (US)

(72) Inventors: Panagiotis Polygerinos, Gilbert, AZ (US); Frederick Sebastian, Tempe, AZ (US); Qiushi Fu, Chandler, AZ (US); Marco Santello, Gilbert, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 704 days.

(21) Appl. No.: 16/212,205

(22) Filed: Dec. 6, 2018

(65) Prior Publication Data

US 2019/0167504 A1 Jun. 6, 2019

Related U.S. Application Data

(60) Provisional application No. 62/595,349, filed on Dec. 6, 2017.

(51) Int. Cl.
*A63B 23/16* (2006.01)
*A63B 21/008* (2006.01)
(Continued)

(52) U.S. Cl.
CPC ..... *A63B 23/16* (2013.01); *A63B 21/0023* (2013.01); *A63B 21/0085* (2013.01);
(Continued)

(58) Field of Classification Search
CPC ..... A63B 21/00069; A63B 21/00076; A63B 21/00178; A63B 21/00189;
(Continued)

(56) References Cited

U.S. PATENT DOCUMENTS 5,626,543 A * 5/1997 Chen ..... A63B 21/0085 482/112
8,939,921 B2 * 1/2015 Brinkhaus ..... A61B 5/225 600/595
(Continued)

FOREIGN PATENT DOCUMENTS

WO 2019183397 A1 9/2019

OTHER PUBLICATIONS

K-Mac Plastics [online], Published Nov. 25, 2010, retrieved from the Internet <URL: https://web.archive.org/web/20101125132728/http://k-mac-plastics.com/silicone-sheets.htm> (Year: 2010).*
(Continued)

*Primary Examiner* — Nyca T Nguyen
*Assistant Examiner* — Zachary T Moore
(74) *Attorney, Agent, or Firm* — Michael Best & Friedrich LLP

(57) ABSTRACT

A pneumatically-actuated soft robotics-based variable stiffness haptic interface device for rehabilitation of a hand includes a body having a flexible outer wall and a cavity defined by the outer wall, the outer wall including a plurality of grooves configured to receive a fiber wound around the outer wall. The device further includes a pneumatic actuator in communication with the cavity and configured to provide pressure to the cavity.

17 Claims, 10 Drawing Sheets

(51) Int. Cl.
*A63B 21/002* (2006.01)
*A63B 21/00* (2006.01)
*A63B 24/00* (2006.01)

(52) U.S. Cl.
CPC ..... *A63B 21/4023* (2015.10); *A63B 24/0087* (2013.01); *A63B 2220/56* (2013.01)

(58) Field of Classification Search
CPC ..... A63B 21/0023; A63B 21/008; A63B 21/0083; A63B 21/0085; A63B 21/0087; A63B 21/0088; A63B 21/4023; A63B 23/16; A63B 24/0087; A61H 2201/5056; A61H 2201/0153; A61H 2201/01685; A61H 2201/50; A61H 2201/1238; A61H 2201/1659; A61H 2201/1409; A61H 2201/169; A61H 2201/5071; A61H 2201/1635
See application file for complete search history.

(56) References Cited

U.S. PATENT DOCUMENTS

| | | | | |
|---|---|---|---|---|
| 10,912,701 | B2 * | 2/2021 | Wijesundara | F15B 18/00 |
| 2006/0063647 | A1 * | 3/2006 | Jones-Glaser | A63B 23/20 482/44 |
| 2011/0118635 | A1 * | 5/2011 | Yamamoto | A61H 1/0262 601/5 |
| 2016/0252110 | A1 * | 9/2016 | Galloway | F15B 15/103 60/327 |
| 2018/0289522 | A1 | 10/2018 | Zhu et al. | |
| 2019/0029914 | A1 | 1/2019 | Polygerinos et al. | |
| 2019/0247217 | A1 | 8/2019 | Govin et al. | |
| 2019/0314980 | A1 | 10/2019 | Polygerinos et al. | |
| 2019/0336315 | A1 | 11/2019 | Polygerinos et al. | |

OTHER PUBLICATIONS

The Thread Exchange, Kevlar Thread [online], Published Jun. 6, 2017 Retrieved from the Internet <URL: https://web.archive.org/web/20170606184215/http://www.thethreadexchange.com/miva/merchant.mvc?Screen=CTGY&Category_Code=Kevlar-Thread>(Year: 2017).*
Bergmann Tiest, "Tactual Perception of Material Properties", Vision Research, 2010, pp. 2775-2782.
Bergmann Tiest et al., "Cues for Haptic Perception of Compliance", IEEE Transactions on Haptics vol. 2, No. 4, pp. 189-199, 2009.
Bishop-Moser et al., "Design and Modeling of Generalized Fiber—Reinforced Pneumatic Soft Actuators", IEEE Transactions on Robotics vol. 31 No. 3, pp. 536-545, 2015.
Deimel et al., "A Compliant Hand Based on a Novel Pneumatic Actuator", IEEE International Conference on Robotics and Automation, 2047-53, 2013.
Duncan et al., "Similar Motor Recovery of Upper and Lower Extremities after Stroke", Stroke; a Journal of Cerebral Circulation vol. 25, No. 6, pp. 1181-1188, 1994.
Foulkes et al., "The Stroke Data Bank: Design, Methods, and Baseline Characteristics", Stroke; a Journal of Cerebral Circulation, vol. 19, No. 5, pp. 547-554, 1988.
Geetha et al., "Estimation of Stature from Hand and Foot Measurements in a Rare Tribe of Kerala State in India", Journal of Clinical and Diagnostic Research vol. 9 No. 10, pp. HC01-HC04, 2015.
Godwin et al., "Cost Associated with Stroke: Outpatient Rehabilitative Services and Medication", Topics in Stroke Rehabilitation, Supplement, pp. 676-684, 2011.
Hankey, "Stroke", The Lancet, vol. 389, pp. 641-654, 2017.
Jones et al., "A Perceptual Analysis of Stiffness", Experimental Brain Research 79 (1), pp. 150-156, 1990.
Jørgensen et al., "Recovery of Walking Function in Stroke Patients: The Copenhagen Stroke Study", Archives of Physical Medicine and Rehabilitation, vol. 76, No. 1, pp. 27-32, 1995.
Khademi et al., "Haptic Augmented Reality to Monitor Human Arm's Stiffness in Rehabilitation", IEEE-EMBS Conference on Biomedical Engineering and Sciences, 2012, pp. 892-895.
Kleim et al., "Principles of Experience-Dependent Neural Plasticity: Implications for Rehabilitation After Brain Damage", Journal of Speech Language and Hearing Research, vol. 51, No. 1, pp. S225-S239, 2008.
Lambercy et al., "Rehabilitation of Grasping and Forearm Pronation/supination with the Haptic Knob", IEEE International Conference on Rehabilitation Robotics, pp. 22-27, 2009.
Legg et al., "Occupational Therapy for Patients with Problems in Personal Activities of Daily Living after Stroke: Systematic Review of Randomised Trials." BMJ (Clinical Research Ed) 335 (7626): 922, 2007.
Mace et al., "Comparison of Isokinetic and Isometric Handgrip Control during a Feed-Forward Visual Tracking Task", IEEE International Conference on Rehabilitation Robotics, pp. 797-792, 2015.
Mace et al., "Elasticity Improves Handgrip Performance and User Experience during Visuomotor Control", Royal Society Open Science 4 (2): 160961, 2017.
Majidi, "Soft Robotics: A Perspective—Current Trends and Prospects for the Future", Soft Robotics, vol. 1 No. 1, pp. 6-11, 2013.
Malosio et al., "An Affordable, Adaptable, and Hybrid Assistive Device for Upper-Limb Neurorehabilitation", Journal of Rehabilitation and Assistive Technologies Engineering, vol. 3, pp. 1-12, 2016.
Masia et al., "Whole-Arm Rehabilitation Following Stroke: Hand Module." Proceedings of the First IEEE/RAS—EMBS International Conference on Biomedical Robotics and Biomechatronics, 2006, pp. 1085-1089.
Nakayama et al., "Recovery of Upper Extremity Function in Stroke Patients: The Copenhagen Stroke Study", Archives of Physical Medicine and Rehabilitation, vol. 75, pp. 394-398, 1994.
Polygerinos et al., "Soft Robotics: Review of Fluid-Driven Intrinsically Soft Devices; Manufacturing, Sensing, Control, and Applications in Human-Robot Interaction", Advanced Engineering Materials, vol. 19, No. 12, pp. 1-22, 2017.
Polygerinos et al, "Soft Robotic Glove for Combined Assistance and at-Home Rehabilitation", Robotics and Autonomous Systems, 73, pp. 135-143, 2015.
Polygerinos et al., "Modeling of Soft Fiber-Reinforced Bending Actuators." IEEE Transactions on Robotics, vol. 31, No. 3, pp. 778-789, 2015.
Popović et al., "Hybrid Assistive Systems for Rehabilitation: Lessons Learned from Functional Electrical Therapy in Hemiplegics", EMBS Annual International Conference of the IEEE Engineering in Medicine and Biology—Proceedings, pp. 2146-2149, 2006.
Seo et al., "Investigation of Grip Force , Normal Force , Contact Area , Hand Size , and Handle Size for Cylindrical Handles", Human Factors, vol. 50, No. 5, pp. 734-744, 2008.
Spagnuolo et al., "Analysis and Synthesis of LinWWC-VSA, a Variable Stiffness Actuator for Linear Motion", Mechanism and Machine Theory 110, pp. 85-99, 2017.
Taylor et al., "Lifetime Cost of Stroke in the United States", Stroke 27 (9), pp. 1459-1466, 1996.
Warraich et al., "Neural Plasticity: The Biological Substrate for Neurorehabilitation." PM and R, vol. 2., No. 12S, Supplement 2, pp. S208-19, 2010.
Wilkinson et al., "A Long-Term Follow-up of Stroke Patients", Stroke; A Journal of Cerebral Circulation 28 (3), pp. 507-512, 1997.
Winstein et al., "A Randomized Controlled Comparison of Upper-Extremity Rehabilitation Strategies in Acute Stroke: A Pilot Study of Immediate and Long-Term Outcomes", Archives of Physical Medicine and Rehabilitation, vol. 85 (4), pp. 620-628, 2004.
Yap et al., "Design and Characterization of Low-Cost Fabric-Based Flat Pneumatic Actuators for Soft Assistive Glove Application", International Conference on Rehabilitation Robotics, pp. 1465-1470, 2017.
Pending U.S. Appl. No. 15/829,597.
Pending U.S. Appl. No. 16/486,072.

* cited by examiner

SOFT ROBOTIC HAPTIC INTERFACE WITH VARIABLE STIFFNESS FOR REHABILITATION OF SENSORIMOTOR HAND FUNCTION

CROSS-REFERENCE TO RELATED APPLICATION

This application claims the benefit of prior-filed U.S. Provisional Patent Application No. 62/595,349, filed Dec. 6, 2017, the entire contents of which are incorporated by reference.

BACKGROUND

The human hand is a complex sensorimotor apparatus that consists of many joints, muscles, and sensory receptors. Such complexity allows for skillful and dexterous manual actions in activities of daily living. When the sensorimotor function of hand is impaired by neurological diseases or traumatic injuries, the quality of life of the affected individual could be severely impacted. For example, stroke is a condition that is broadly defined as a loss in brain function due to necrotic cell death stemming from a sudden loss in blood supply within the cranium. This event can lead to a multitude of repercussions on sensorimotor function, one of which being impaired hand control such as weakened grip strength. Other potential causes of impaired hand function include cerebral palsy, multiple sclerosis, and amputation. Therefore, effective rehabilitation to help patients regain functional hand control is critically important in clinical practice. It has been shown that recovery of sensory motor function relies on the plasticity of the central nervous system to relearn and remodel the brain. Specifically, there are several factors that are known to contribute to neuroplasticity: specificity, number of repetition, training intensity, time, and salience. However, existing physical therapy of hand is limited by the resource and accessibility, leading to inadequate dosage and lack of patients' motivation. Robot-assisted hand rehabilitation has recently attracted a lot attention because robotic devices has the advantage to provide 1) enriched environment to strengthen motivation, 2) increase number of repetition through automated control, and 3) progressive intensity levels that adapts to patient's need.

SUMMARY

The human hand comprises complex sensorimotor functions that can be impaired by neurological diseases and traumatic injuries. Effective rehabilitation can bring the impaired hand back to a functional state because of the plasticity of the central nervous system to relearn and remodel the lost synapses in the brain. Synaptic plasticity can be further augmented by training specific parts of the brain with motor tasks in increasing difficulty. Current rehabilitation therapies focus on strengthening motor skills, such as grasping, employing multiple objects of varying stiffness so that affected persons can experience a wide range of strength training. These objects also have limited range of stiffness due to the rigid mechanisms employed in their variable stiffness actuators.

Certain embodiments described herein provide a soft robotic haptic device for neuromuscular rehabilitation of the hand, which is designed to offer adjustable stiffness and can be utilized in both clinical and home settings. The device eliminates the need for multiple objects by utilizing a pneumatic soft structure made with highly compliant materials that act as the actuator and the body of the haptic interface. It is made with interchangeable sleeves that can be customized to include materials of varying stiffness to increase the upper limit of the variable stiffness range. The device is fabricated using 3-D printing technologies, and polymer molding and casting techniques thus keeping the cost low and throughput high. The haptic interface is linked to either an effective open-loop or closed-loop control system depending on the desired mode of actuation. The former allows for an increased pressure during usage, while the latter provides pressure regulation in accordance to the stiffness the user specifies.

Preliminary evaluation was performed to characterize the effective controllable region of variance in stiffness. The two control systems were tested to derive relationships between internal pressure, grasping force exertion on the surface, and displacement using multiple probing points on the haptic device. Additional quantitative evaluation was performed with study participants and juxtaposed to a qualitative analysis to ensure adequate perception in compliance variance.

In one embodiment, the invention provides a pneumatically-actuated soft robotics-based variable stiffness haptic interface device for rehabilitation of a hand. The device comprises a body including a flexible outer wall and a cavity defined by the outer wall, the outer wall including a plurality of grooves configured to receive a fiber wound around the outer wall, and a pneumatic actuator in communication with the cavity and configured to provide pressure to the cavity.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Haptic interfaces and variable stiffness mechanisms are usually incorporated into robotic rehabilitation devices to provide varying difficulties by adjusting force output or stiffness. These devices and systems, however, are either costly or bulky due to complex mechanical design, or have limited range of stiffness due to passive mechanical components.

Figure 1:
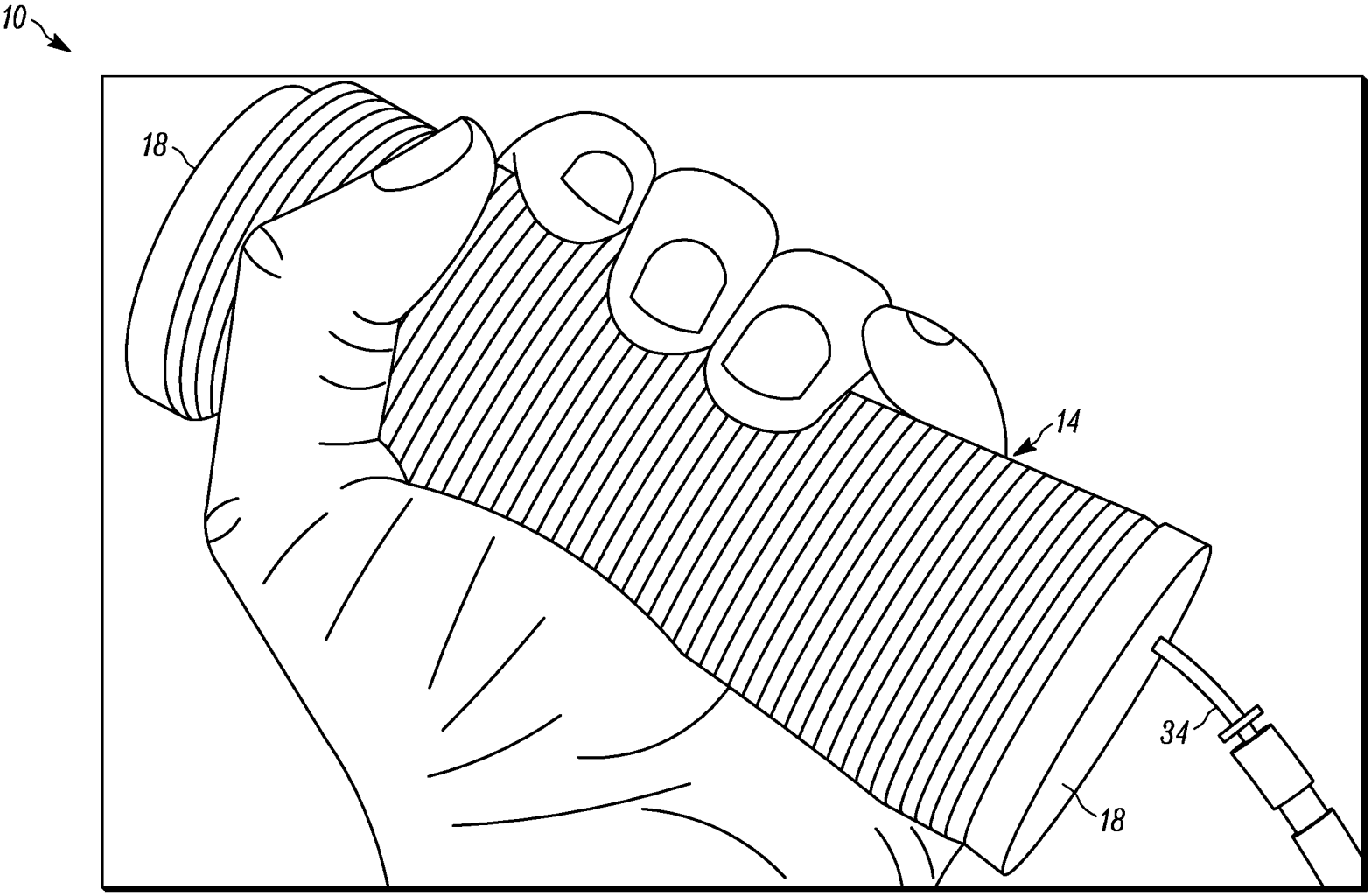
FIG. 1 illustrates a pneumatically-actuated device for supporting rehabilitation of sensorimotor function of hands according to an embodiment of the present invention.

To overcome these limitations, the design of a novel pneumatically-actuated soft robotics-based variable stiffness haptic interface 10 is presented to support rehabilitation of sensorimotor function of hands (FIG. 1). Soft robotics is a rapidly growing field that utilizes highly compliant materials that are fluidic actuated to effectively adapt to shapes and constraints that traditionally rigid machines are unable to. Several soft-robotics devices have been developed to provide assistance to stroke patients, but none of these have been designed as resistive training devices. An example of an existing device includes the use of soft actuators that bend, twist, and extend through finger-like motions in a rehabilitative exoglove to be worn by stroke patients. A variable stiffness device that employs soft-robotics allows a greater range of stiffness to be implemented since there is minimal or no impedance to the initial stiffness of the device. Additionally, soft robotics methods allow devices to be manufactured with lowered cost and have much less complexity, thus suitable to be used not only inpatient but also outpatient hand rehabilitative services.

Figure 2:
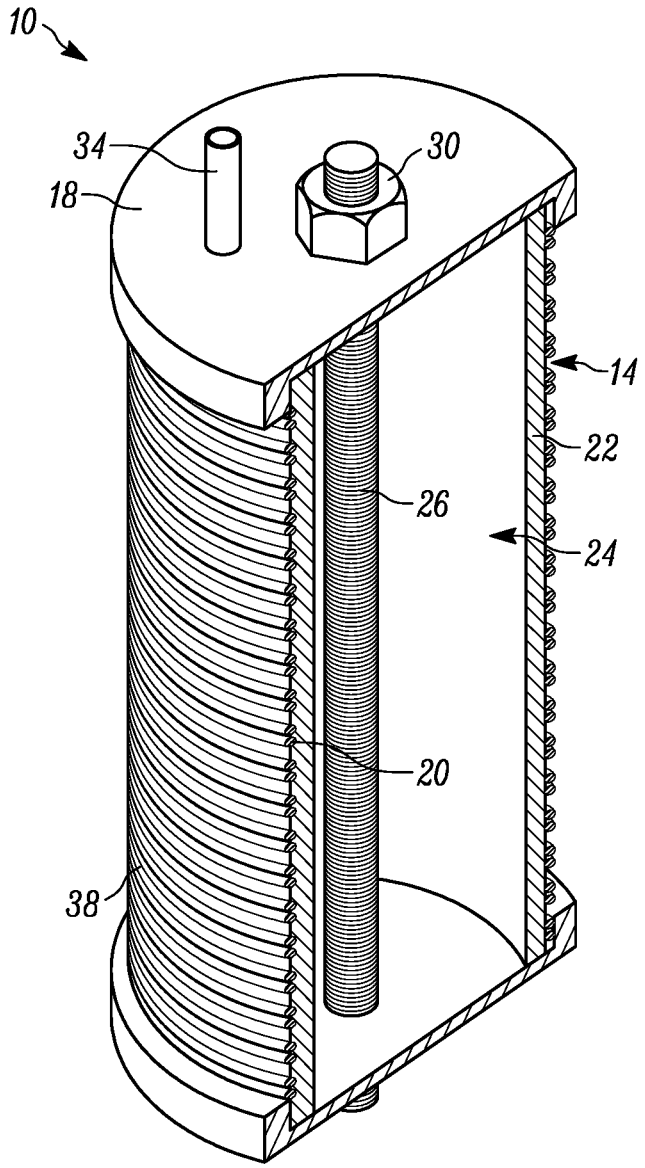
FIG. 2 is a cross-sectional view of the device illustrated in FIG. 1.

As shown in FIG. 2, the device 10 may include a cylindrical handle 14 having a diameter. In the illustrated embodiment, the diameter is 40 mm since this diameter has been shown to be most effective in enabling high grip forces in humans. In other constructions, the handle 14 also is capable of having other suitable dimensions for the diameter, such as, for example, 35 mm to 45 mm. The average male hand width, defined as the distance from the second to the fifth metacarpophalangeal joints, is approximately 83 mm. The handle 14 includes a height, and in one embodiment, the height is 120 mm. In other constructions, the height of the handle 14 is capable of having other suitable dimensions, such as, for example, 115 mm to 125 mm. The approximately 40 mm additional length was added to ensure the entire body 14 of the device 10 fits in a patient's grip, accommodate for hand widths larger than the average, and to account for higher stiffness in areas closer to the end caps 18 of the device 10 (see FIG. 6). The male hand width is used as the basis of the design since on average the male hand is larger than the female hand. The device 10 was modeled using computer-aided design (CAD) software before the device was made. In the illustrated embodiment, a mold was made for its body 14 and the end caps 18 were 3-D printed. The body 14 was cast out of silicon elastomer material, although other materials may be used. In the illustrated embodiment, the body 14 is hollow and a wall of the body 14 defines a cavity 24. The end caps 18 coupled to the body 14 enclose the cavity 24. A radial constraint (e.g., a wound fiber 38) is coupled to the body 14. In the illustrated embodiment, the mold of the body 14 included grooves 20 in a helical pattern along the body 14 of the device 10 to facilitate the fiber winding process during fabrication, as described below.

In some embodiments, the body 14 of the device 10 may be fabricated based on a multistep molding and casting technique that has been established for creating fiber-reinforced soft actuators. However, some features and components may be modified according to the goal of constraining the device from expanding vertically and horizontally, as well as to prevent bending and twisting motions. Instead of a hemisphere or a rectangle, the body of the mold may be made in a circular design to achieve a cylindrical hand-held device, and 3D-printed. The first layer 22 may be casted with the printed mold using a shore hardness 10A silicone rubber with 2 mm thickness. End caps 18 of 50 mm diameter and 5 mm thickness may be 3-D printed.

The caps 18 may include a hole in the center to introduce a threaded rod 26, acting as a core, which was positioned within the cavity of the body 14 and was fastened on both ends with locking nuts 30. In the illustrated embodiment, the hole has a diameter of 6 mm, and the threaded rod 26 has a length of 178 mm. In other constructions, the core 26 may be formed from a member other than the threaded rod. Additionally, a hole off the edge of the first hole is used to introduce a tube 34 for pneumatic actuation. In the illustrated embodiment, the hole has a diameter of 3 mm, and is spaced approximately 4 mm off the edge of the first hole. The end caps 18 are attached to the body of the actuator 10 using silicone adhesive (Sil-Poxy Adhesive, Smooth-on Inc., PA, USA). This adhesive may also be used around the connecting parts to prevent air leaks, i.e., around the base of the cap 18 and the body 14, and at the ends of the core 26. A single Kevlar fiber 38 is wound along the grooves 20 made from the mold in clockwise and counter clockwise directions, and a thin layer of silicone was applied on the fiber threading 38 to anchor it in place and prevent it from moving during actuation and grasping. A second layer 2-mm thick was made with the same casting techniques, but with a shore hardness 20A silicone rubber, and used as a sleeve over the first layer 22. Although certain example embodiments described in this application achieve radial constraint through the inclusion of a wound fiber (e.g., fiber 38), those of ordinary skill in the art will, having studied the teachings in this application, recognize and appreciate that, in certain embodiments, the device may be configured to achieve radial constraint in other ways including, but not limited to, through the inclusion of a stiffer silicone or different stiffness elastomer patterns, electroactive polymer patterns, or otherwise without the use of a wound fiber (e.g., plastic rings, elastic rings, fabric strips, or braided meshes). In certain embodiments, device 10 may include one or more radial constraints, one example of which includes, but is not limited to, a wound fiber such as fiber 38.

The first layer 22 of the device 10 may be made with very flexible rubber to ensure the lower limit of the device's stiffness is kept at a minimum while it is directly exposed to pressure. However, the high compliance of the first layer 22 compromises its structural integrity. Therefore, a secondary layer of the same compliance may be made as a sleeve over the first 22. The user may utilize a third sleeve with less compliant materials to increase the upper limit of the device's stiffness range. The interchangeability of sleeves provides greater customization and adaptability for the user's specific needs. Additionally, the interchangeability feature allows for improved sanitary environments by allowing physicians to swap sleeves between patients quickly.

Figure 3:
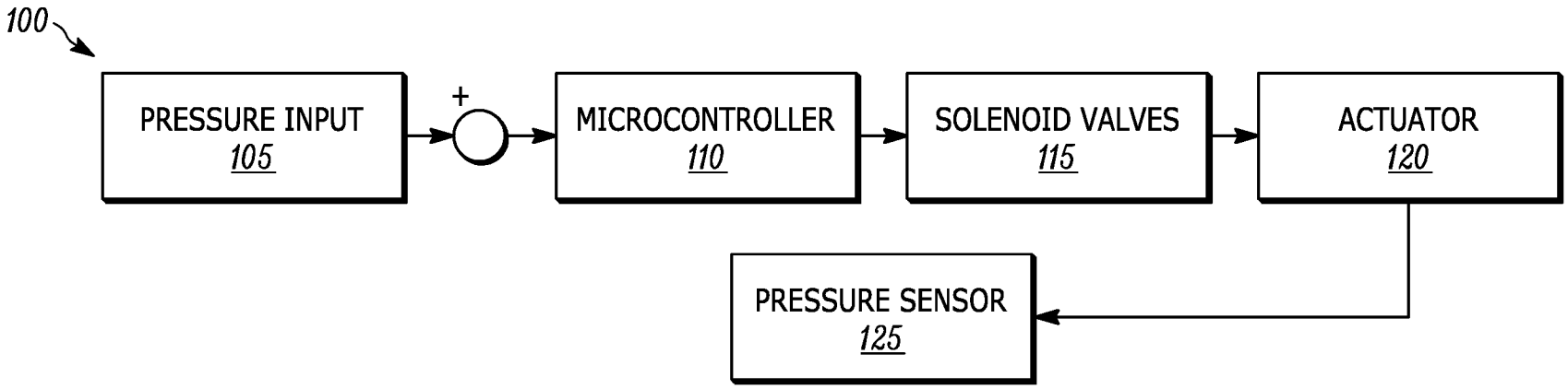
FIG. 3 is a block diagram of an open-loop control system of an isometric mode of operation.
Figure 4:
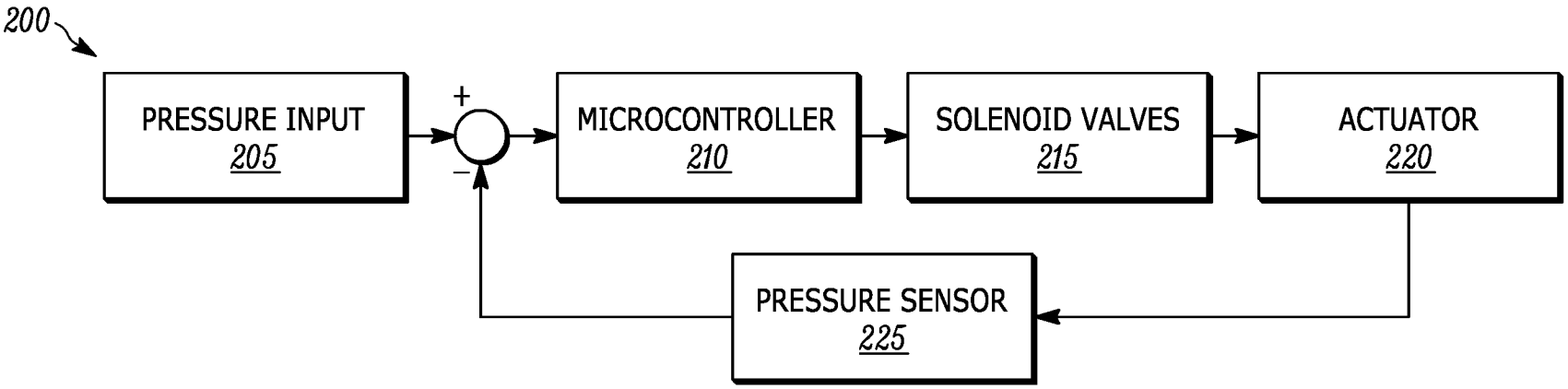
FIG. 4 is a block diagram of a closed-loop control system of a constant pressure mode of operation.

There are two modes of operation of the soft robotic haptic interface: 1) isometric 100 and 2) constant pressure 200. The former mode 100 is a system with no pressure regulation. Therefore, the device is given a starting pressure (greater than 0 kPa) (105) and the internal pressure is allowed to increase with an increased force exertion on the device 10. This actuation system is shown on the open-loop control system block diagram in FIG. 3. The latter mode 200 of operation involves regulated pressure. Therefore, the device 10 is given a starting pressure (greater than 0 kPa) (205), and the internal pressure is maintained at that pressure as the hand grasping force exerted on the device 10 is increased. This actuation system is shown on the closed-loop control system block diagram in FIG. 4.

In the open-loop mode 100, the pressure sensor (125) is utilized to monitor the pressure variations inside the device. The microcontroller (110) is set to keep the solenoid valves (115) closed, thereby preventing a pressure drop in the actuator (120) once the initial pressure (205) has been set.

The design for the closed-loop system 200 is achieved by employing solenoid valves (215) to both pressurize and depressurize the actuator (220) based on the user's input. The pressure input (205) is fed through solenoid valves (Series 11 Miniature Solenoid Valves, Parker Hannifin Corp., OH, USA) (215) before they split to equal pressures in the haptic interface and a fluidic pressure sensor (ASDXAVX100PGAA5, Honeywell International Inc., Morris Plains, N.J.) (225). The pressure sensor (225) provides feedback to a microcontroller (Arduino Uno R3, Arduino LLC., Italy) (210) to turn the solenoid valves (215) on and off to regulate the pressure to an approximate accuracy of 0.69 kPa. When the pressure sensor (225) reads the pressure input to be higher or lower than the desired preset input (205), it will depressurize or pressurize, respectively.

Generally, an object's stiffness is described by the Young's Modulus, which is the ratio of the pressure (force per unit area) applied on the object and its relative deformation. However, for small strains, as expected in this case, the compliance of the soft haptic interface 10 can still be characterized by the ratio of the force exerted on it and the resulting displacement. The equation describing this characterization is shown in Eq. 1, where k, Δx, and F represent stiffness, displacement and force applied, respectively.

$$k=F/\Delta x \quad \text{(Eq. 1)}$$

Figure 5A:
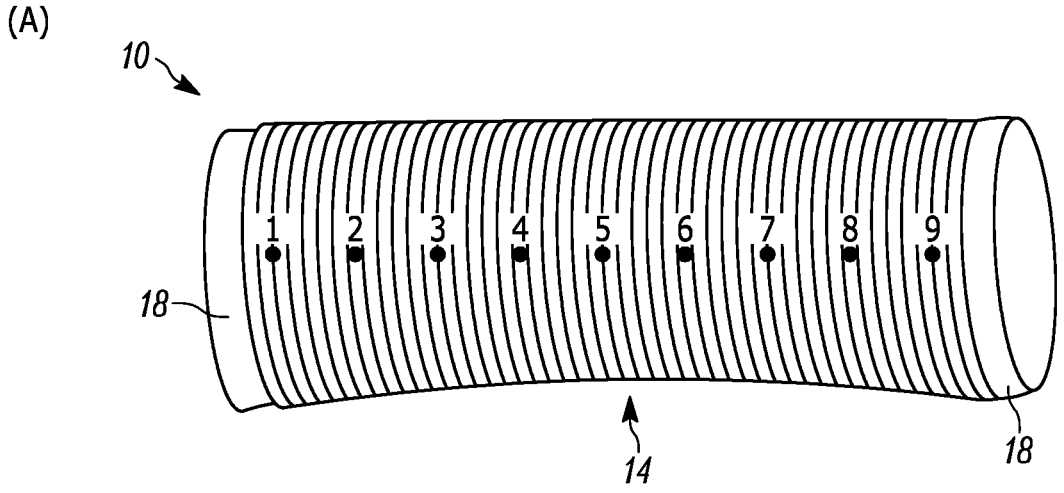
FIG. 5A illustrates the device of FIG. 1 marked for a stiffness characterization experiment to determine the stiffness profile of the grasping area.
Figure 5B:
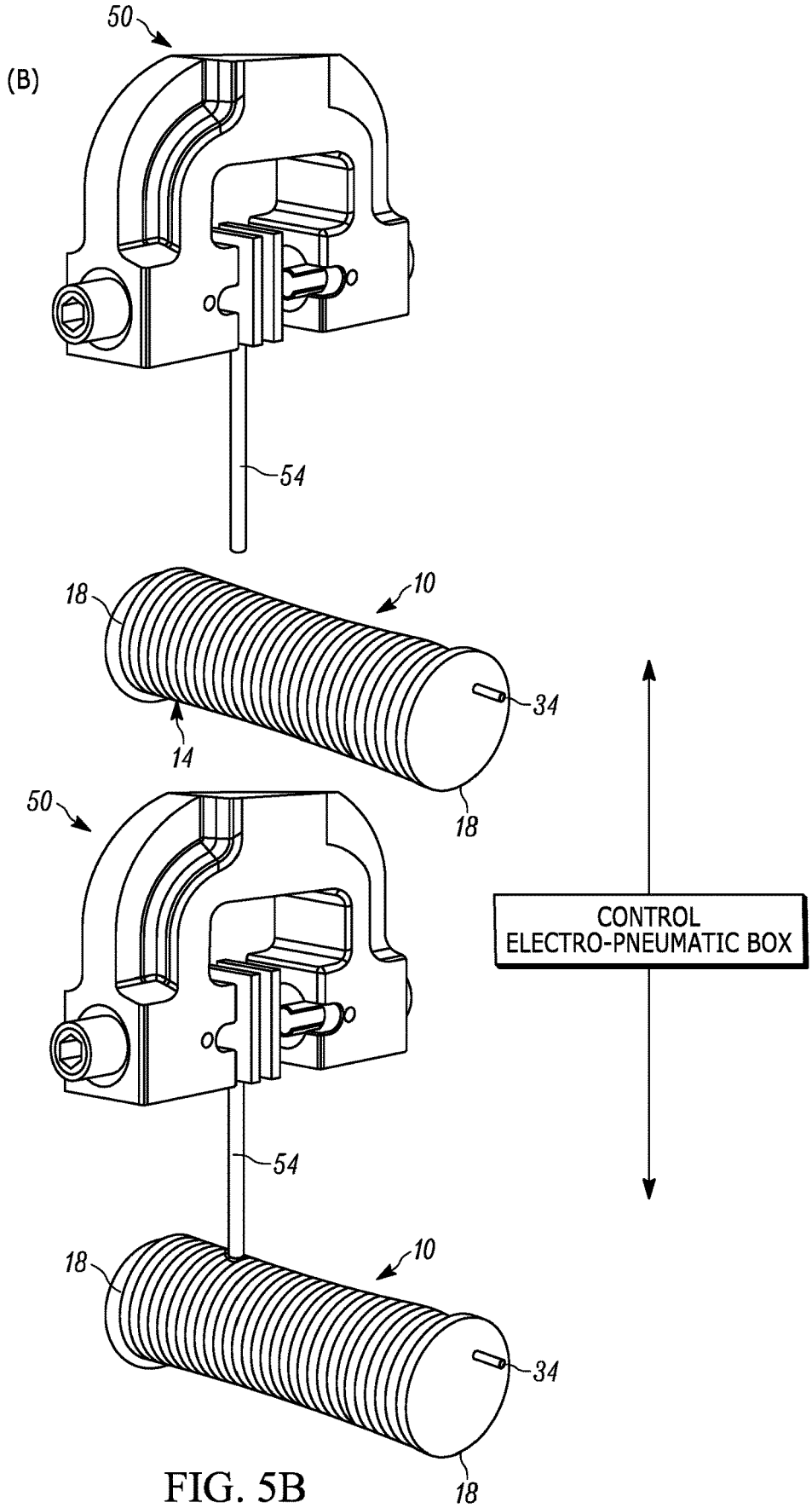
FIG. 5B illustrates a testing apparatus for conducting the stiffness characterization experiment.

A stiffness characterization experiment was performed to determine the stiffness profile of the grasping area of the soft robotic haptic interface 10. This was done by marking the device's soft body with nine linear points with spacing of 15 mm in between in each point (FIG. 5A). Point 1 is the point closest to the end cap 18 on the side with a pneumatic tubing 34, and Point 9 is at the furthest opposite end. The device 10 is fixed in place by the core 26 using a bar clamp (not shown) with the marked points being exposed upwards. The clamp is attached to the lower grip of a uniaxial testing machine 50 while a probe 54 of 6-mm diameter is attached on the upper grip (FIG. 5B).

The probe 54 is positioned right above the point to be tested, and force and position of the probe 54 are set to 0 N and 0 mm, respectively. In a quasi-static, cyclical (loading-unloading) experiment the probe 54 is set to lower a maximum of 10 mm into the soft material body 14 of the device 10 while a preset pressure is provided at the beginning of the experiment. The resulting force and displacement of the probe 54 are recorded. A total of three trials are performed per probing point, and the exerted force and displacement are averaged. The characterization experiment is repeated with preset pressurizations of 3.45, 6.89, 13.79, and 20.68 kPa.

For the constant pressure mode of operation, a similar test to the characterization experiment is performed but the closed-loop system 200 is utilized instead. Additionally, the mid-point on the device (Point 5) is selected as the only probing location to record the resulting force. A total of three trials are performed, and the exerted force is averaged. This is repeated with pressurizations of 3.45, 6.89, 13.79, and 20.68 kPa.

For the isometric mode 100 of operation, this quasi-static experiment is performed while using the open loop system. This experiment also utilized the mid-point (Point 5) on the device as the only probing location. However, the probe 54 is set to probe four times with 2.5-mm intervals between each vertical probing distance (starting at 2.5 mm) for a given starting pressurization. The resulting pressure and the force exerted on the device 10 was then recorded. The stiffness per displacement is then calculated using Eq. 1 and plotted against the pressure recorded for that displacement. Three trials per displacement were performed, and the exerted force and pressure were averaged. This experiment was repeated with pressurizations of 3.45, 6.89, 13.79, and 20.68 kPa.

To maximize the efficacy of this variable stiffness device 10, the change in compliance is adequately perceived by the person using the device. This is because the essence of this technology is to have variance in stiffness that begins with as minimal resistance as possible to better the rigidity experienced in existing variable stiffness devices. Therefore, the end user needs to be able to readily differentiate the stiffness of the device 10 from the lowest stiffness setting up to the highest. More importantly, perception of stiffness often involves a variety of somatosensory modalities such as mechanoreceptors, muscle spindles, and Golgi tendon, as well as the ability to coordinate joint positions and contact forces. Therefore, these types of tasks could have potential application in the rehabilitation of sensorimotor function of hands.

Figure 8A:
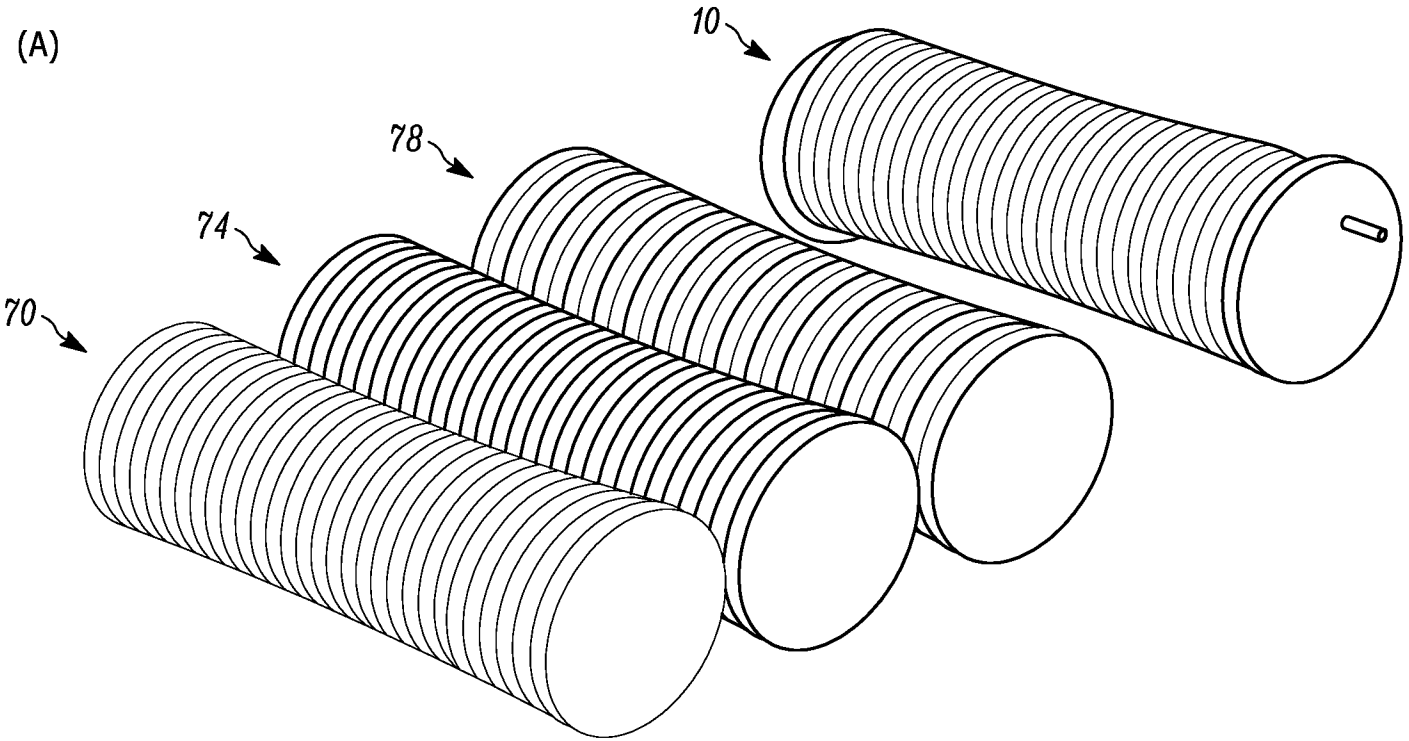
FIG. 8A illustrates several devices having varying Shore hardness values.

To test the stiffness perception, the soft haptic device 10 was set at a constant pressure utilizing the open-loop control system 100. The stiffness per pressure setting (3.45, 6.89, or 20.68 kPa) is approximated to three distinct Shore Hardness values (00-10, 00-30, and 00-50, respectively). As shown in FIG. 8A, three cylindrical objects of Shore Hardness 00-10 (object 70), 00-30 (object 74), and 00-50 (object 78) of the same dimensions as the soft haptic device 10 were then fabricated but with a filled center. Subjects were asked to grasp the three filled cylindrical objects 70, 74, 78 and then grasp the soft haptic device 10 that is set at a pressure setting unknown to them. The number of attempts it took the subject to match it to our set Shore Hardness for the given pressurization was then recorded. This qualitative experiment is repeated with the same subject but at a different pressure setting. This experiment was conducted with 17 healthy participants who gave their full written and oral consent before participation.

Figure 6A:
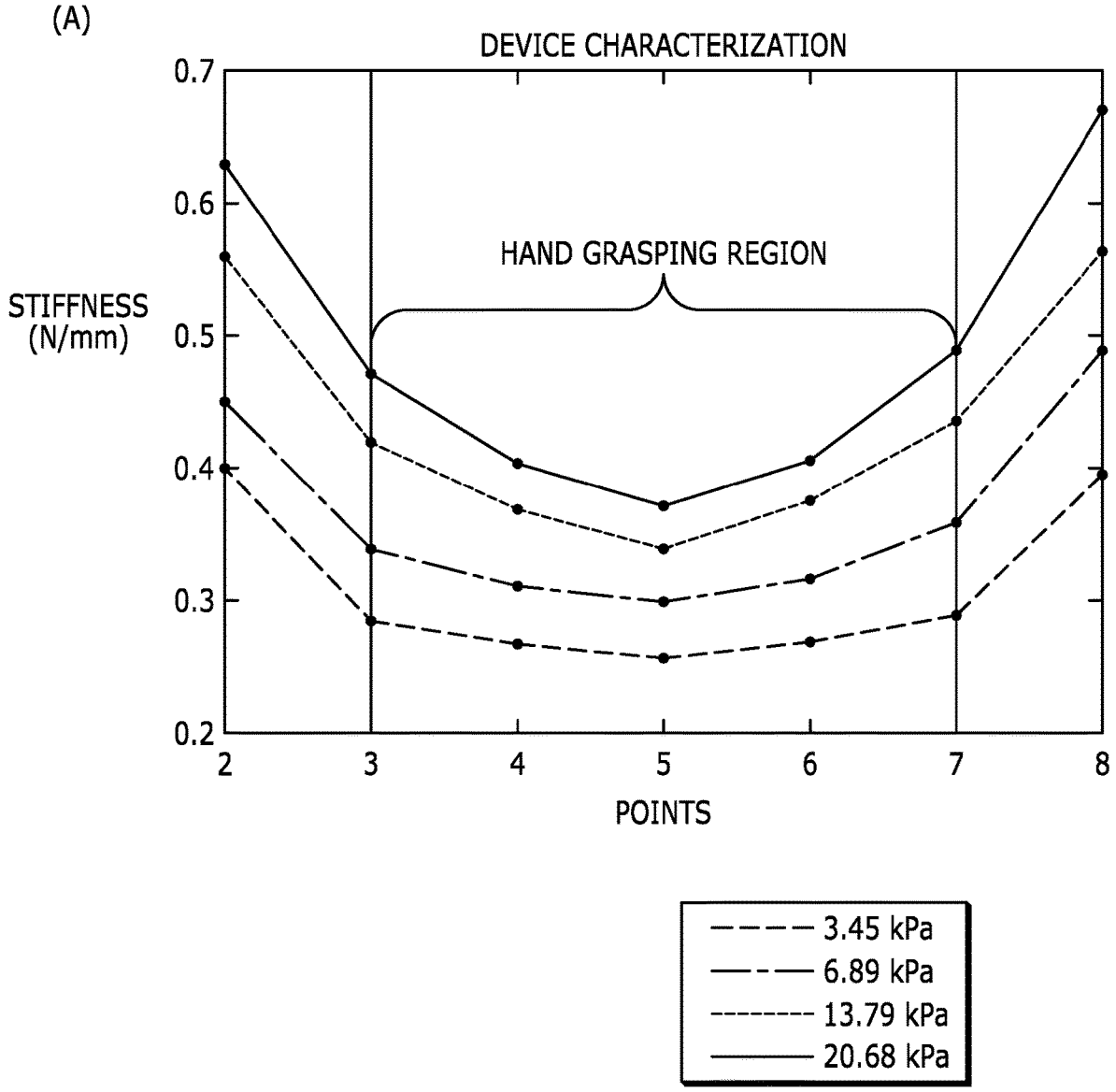
FIG. 6A graphically illustrates results of the characterization test of the device illustrated in FIG. 1.
Figure 6B:
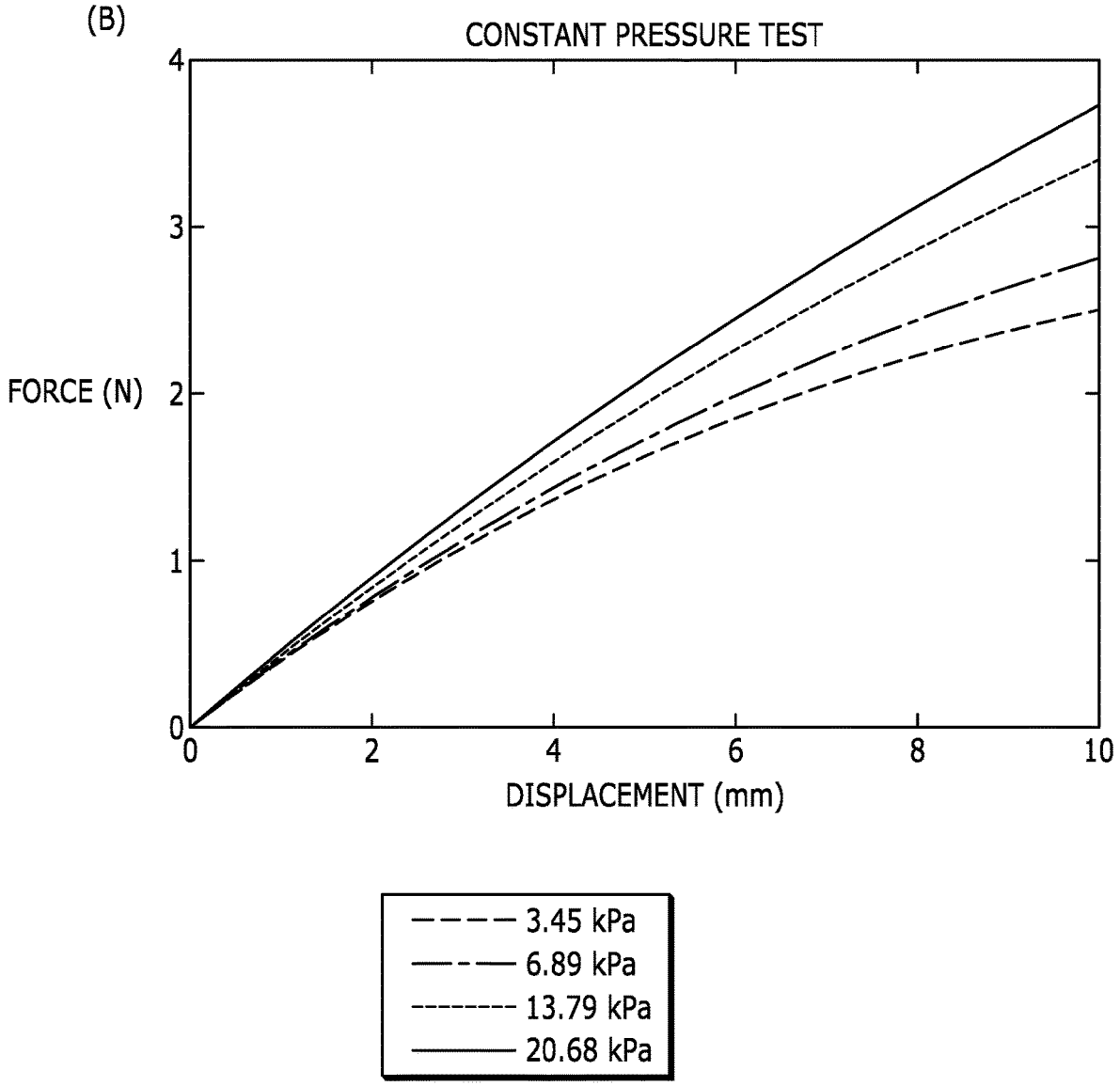
FIG. 6B graphically illustrates exerted force and displacement of the device illustrated in FIG. 1 with varying pressures using the constant pressure system illustrated in FIG. 4.
Figure 7:
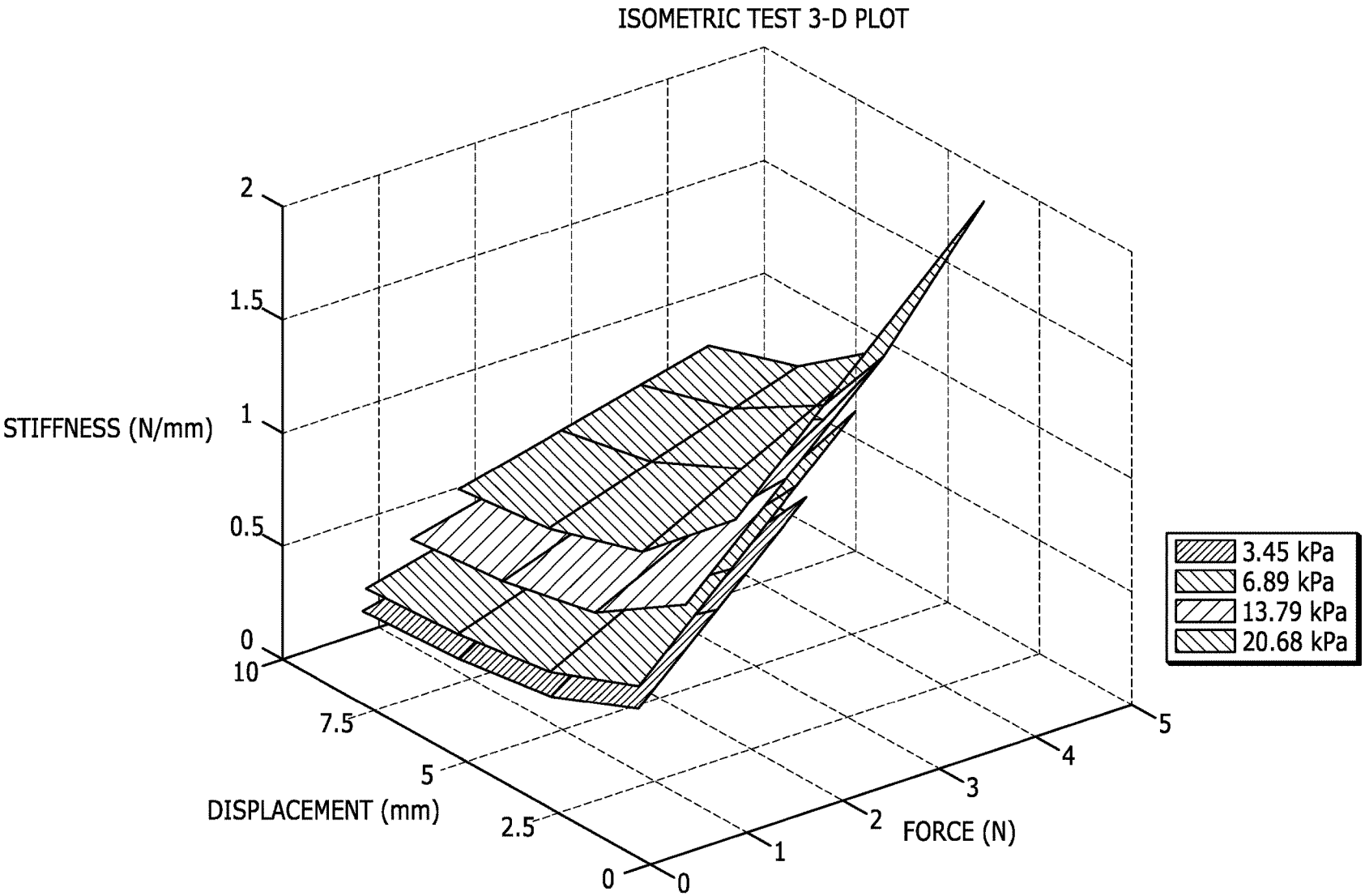
FIG. 7 graphically illustrates the relationship between stiffness, displacement, and force, and indicates that a controllable increased stiffness with varying pneumatic actuation in the device enables the device to increase its stiffness when a gradual force is exerted on it.

The stiffness profile versus the points on the device with varying pressures is presented in FIGS. 6A-B. The device 10 was expected to be stiffer as one moves away from the middle (Point 5) of the device. This expectation was consistent with experimental results from the characterization test of the soft haptic device 10 (FIG. 6A). The device 10 has greater stiffness at points closer to the end caps 18 and therefore the regions of effective variable stiffness can be identified between points 3 and 7 where the stiffness for each pressure appears to be relatively linear. The greater stiffness towards either end of the device 10 is mainly due to the influence of the bond between the end caps 18 and the body 14 of the actuator 10. For this reason, Points 1 and 9 were excluded from the data. The graph of the exerted force and displacement with varying pressures using the constant pressure system is presented in FIG. 6B. Using this plot the end user has the ability to select a fixed stiffness value when using the soft haptic interface 10 in a constant pressure mode 200 to perform grasping exercises where the haptic feel remains the same irrespective of the grasping force exerted on the device 10. Conversely, the stiffness reduced for every increment in displacement in the isometric testing (FIG. 7), however, the drop was consistent for every pressure input. This validates the concept of a controllable increased stiffness with varying pneumatic actuation in the soft haptic interface 10, which enables the device 10 to increase its stiffness when a gradual force is exerted on it. Overall, the two modes 100, 200 allow for stiffness values to be adjusted on demand to higher or lower ranges through variations of the initial stiffness of the sleeves and the internal pneumatic pressure.

Figure 8B:
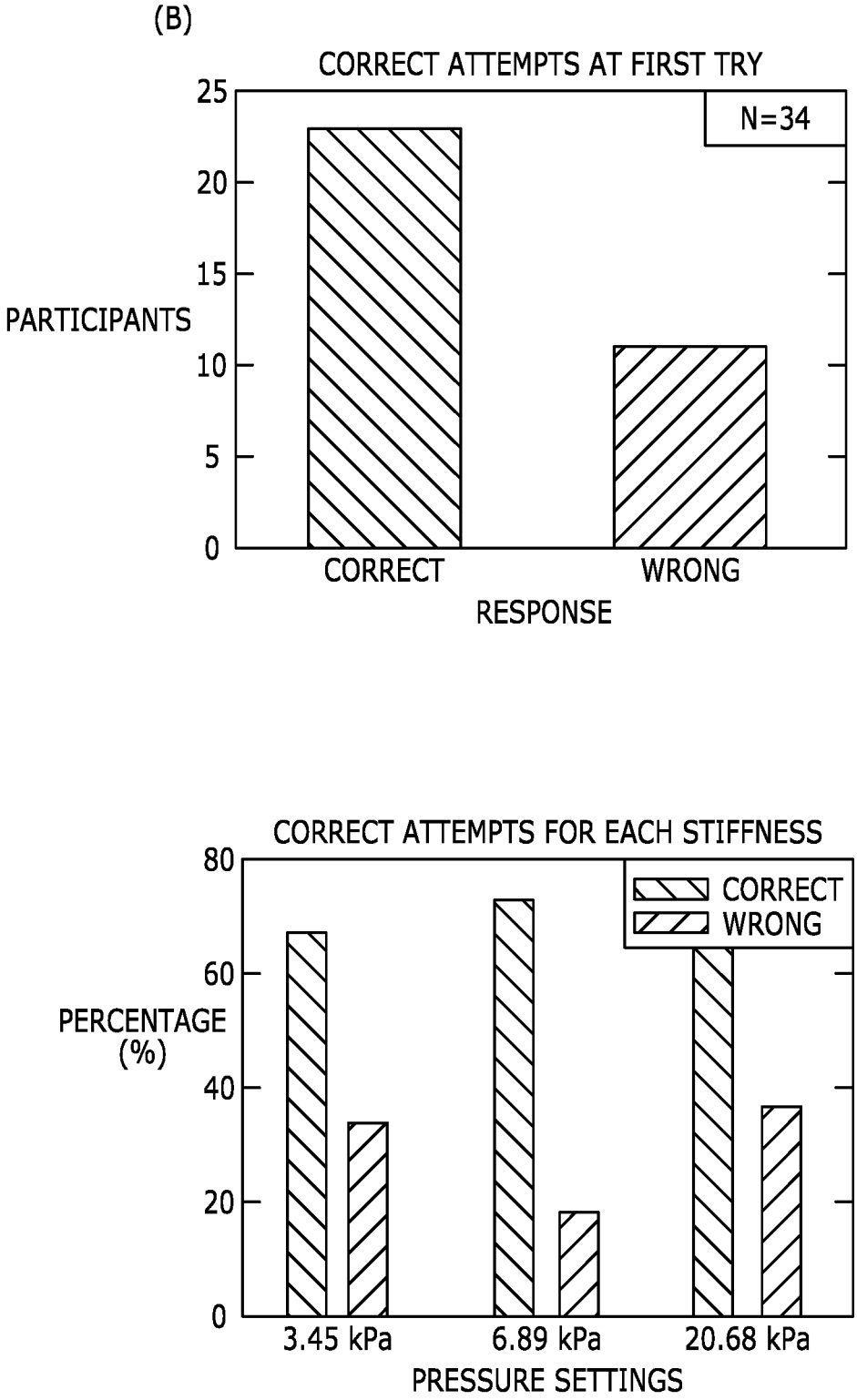
FIG. 8B graphically illustrates subjects' attempts at matching stiffness of the device with its pressure setting.

Additionally, the efficacy of the device 10 was tested using 34 test subjects to grasp the device 10 at varying stiffness settings. Out of the 34 test subjects, 23 of them (or 68%) matched the stiffness of the device 10 correctly in their first attempt as seen in FIG. 8B. This number was then further broken down for the three stiffness settings and it was found that 67%, 73%, and 64% of the subjects matched the stiffness correctly in their first attempt for the Shore 00-10 70, Shore 00-30 74, and Shore 00-50 78 cylinders, respectively, as shown in FIG. 8B.

A novel design of a variable stiffness haptic interface 10 based on soft robotics that is pneumatically actuated to assist hand rehabilitation is described herein. The fabrication process of this device 10 is simple and cost-effective since it closely adheres to existing multistep casting and molding techniques utilized for fiber-reinforced soft actuators. The utilization of highly compliant materials (silicone elastomers) allowed for the device to present stiffness ranges that existing variable stiffness devices are not able to achieve due to the rigidity of their mechanical designs. Experiments were conducted to characterize the effective regions of variable stiffness in the soft haptic device 10 due to design constraints that include regions of exponential stiffness. A closed-loop and open-loop control system 200, 100 were presented and tested. Finally, the variance of stiffness in the device was tested with healthy subjects to ensure that the induced variance in stiffness translates adequately to a qualitative measure as well. One of the most challenging aspects of creating a device of variable stiffness is to ensure the variance in compliance is appropriately perceived by the users. This is challenging due to the multitude of factors involved in human perception of stiffness (Bergmann Tiest 2010; Jones and Hunter 1990). The experiment results show that healthy subjects could effectively distinguish the variance in stiffness of the soft haptic device 10, and that the qualitative measurement could be matched to a quantitative value (Shore Hardness). This allows for a more cohesive mapping of the soft haptic device 10, and therefore provides the device's user(s) the tool necessary to utilize the device 10 effectively. The main findings and potential applications of the soft-robotics device for rehabilitation of sensorimotor function of hands are discussed.

The central region (Points 3 to 7, FIG. 6A) is characterized by an increasing stiffness that could be manipulated on demand by the end user or physical therapist in a controlled fashion by increasing the pressure input to the device 10. It is important to note that only four different pressure settings were tested in this work as a proof-of-concept. If desired, additional pressure settings can be utilized for this particular design. However, the maximum pressure input presented was 20.68 kPa so as to prevent the device 10 from buckling under greater internal pressure. To increase the upper limit of the pressure input, a greater number of sleeves can be added to the device 10, sleeves of higher stiffness can be incorporated into the design, and/or the number of windings 38 on the first layer 10 could be increased. This once again proves the versatility of this device to be used in stroke rehabilitation given the importance of tailoring task difficulty or characteristics to individual patients' sensorimotor deficits.

The constant pressure test support using the device to calculate the stiffness a user can expect when using the device 10 at a given regulated pressure. This could be eventually used to formulate a chart for quick reference if a particular setting is desired for a rehabilitative exercise to be performed. This setting can be utilized for strength training that requires a large number of hand grasping/squeezing repetitions since high repetitions have shown to increase neural plasticity in stroke recovery. The isometric mode 100 provides the user with an option to increase the force needed to squeeze the device 10 at a given pressure, thus being useful for users who need consistent increases in difficulty for each rehabilitative exercise. These two different modes 100, 200 can be utilized by the physician depending on the needs of the stroke patient. However, the results of this testing showed that the stiffness dropped for 2.5 mm increments in the displacement using the isometric system 100. Given that the stiffness increased during characterization which utilized the same control system, it appears that the pressure in the soft haptics is escaping when small displacements occur in the device.

The results demonstrated great potential to use the device in a variety of hand rehabilitation exercises. For instance, patients who need fixed stiffness with increased repetitions of grasping exercise could use the constant pressure control mode 200; and patients who need increasing difficulty could utilize the isometric control mode 100. Furthermore, with a sensor added to the device 10, patients can use it as a controller at home to perform exercises in combination with video games to mimic augmented reality feedback that currently exists for rehabilitation devices (Khademi et al. 2012). Lastly, the device 10 has the unique feature that the entire grasp area is compliant due to the implementation of soft robotics techniques. Unlike hand rehabilitation devices with rigid mechanisms, our design could promote the practice of natural coordination among all fingers which is important in ADL tasks.

Various features and advantages of certain embodiments are set forth in the following claims.

What is claimed is:

1. A pneumatically-actuated soft robotics-based variable stiffness haptic interface device for rehabilitation of a hand, the device comprising:

a body including a flexible outer wall and a cavity defined by the outer wall, the outer wall including a plurality of grooves configured to receive a fiber wound around the outer wall, wherein the body is sized and shaped to be gripped by the hand during use; and a pneumatic actuator in communication with the cavity and configured to provide pressure to the cavity;

wherein in an open loop mode the pneumatic actuator is configured to provide a predetermined pressure to the cavity and an internal pressure of the cavity is allowed to increase with an increased force applied to the device, and wherein in a closed loop mode the pneumatic actuator is configured to provide constant control, the cavity is given a starting pressure, and the internal pressure is configured to be maintained at the starting pressure as increased force is applied to the device.

2. The device of claim 1, wherein the outer wall comprises silicone.

3. The device of claim 1, further comprising a first end cap secured to a first end of the outer wall and a second end cap secured to a second end of the outer wall.

4. The device of claim 3, further comprising a rod secured to the first end cap and the second end cap and extending between the first end cap and the second end cap inside the cavity.

5. The device of claim 1, wherein the outer wall comprises a first layer of shore hardness 10A silicone rubber.

6. The device of claim 5, wherein the outer wall comprises a second layer of shore hardness 20A silicone rubber.

7. The device of claim 1, further comprising the fiber, wherein the fiber is wound around the body in clockwise and counter clockwise directions.

8. The device of claim 1, further comprising:

a controller configured to set the predetermined pressure in the cavity, a solenoid valve in communication with the controller, the solenoid valve configured to remain closed, wherein the pneumatic actuator is in communication with the solenoid valve, and a pressure sensor in communication with the pneumatic actuator and the cavity, the pressure sensor configured to monitor pressure variations in the cavity.

9. The device of claim 1, further comprising:

a controller configured to set the predetermined pressure in the cavity, a pressure sensor configured to monitor pressure in the cavity, the pressure sensor in communication with the controller, and a solenoid valve in communication with the controller and configured to regulate the pressure in the cavity to the set pressure based on feedback from the pressure sensor, and wherein the pneumatic actuator is in communication with the solenoid valve and the pressure sensor.

10. The device of claim 1, wherein the body is cylindrical, and has a diameter between 35 mm and 45 mm and a height between 115 mm and 125 mm.

11. A pneumatically-actuated soft robotics-based variable stiffness haptic interface device for rehabilitation of a hand, the device comprising:

a cylindrical body including a flexible outer wall and a cavity defined by the outer wall;

a pneumatic actuator in communication with the cavity and configured to provide pressure to the cavity, a pressure sensor to monitor a pressure in the cavity, and a valve configured to regulate the pressure in the cavity in response to a user supplied force that acts radially on the flexible outer wall;

wherein the pressure sensor is configured to measure the pressure of the cavity, and wherein the pressure measured by the pressure sensor of the cavity is greater than a predetermined pressure as the user supplied force applied to the device increases.

12. The device of claim 11, further comprising an end cap secured to a first end of the outer wall, the end cap including a pneumatic tube for providing fluid communication between the cavity and the pneumatic actuator.

13. The device of claim 11, wherein the outer wall includes a plurality of grooves and a fiber is disposed in the plurality of grooves and wound around the outer wall.

14. The device of claim 11, wherein the outer wall comprises silicone.

15. The device of claim 11, further comprising a controller coupled to the valve, wherein the controller is configured to open and close the valve to regulate a flow of air into and out of the cavity and to maintain a constant pressure within the cavity when the user applies the radial user supplied force.

16. The device of claim 15, wherein the body is cylindrical and has a diameter between 35 mm and 45 mm, and has a height between 115 mm and 125 mm, wherein the body is configured to be gripped by a hand of the user.

17. A pneumatically-actuated soft robotics-based variable stiffness haptic interface device for rehabilitation of a hand, the device comprising:

a cylindrical body including a flexible outer wall and a cavity defined by the outer wall;

a pneumatic actuator in communication with the cavity and configured to provide pressure to the cavity;

a pressure sensor to monitor a pressure in the cavity;

a valve configured to regulate the pressure in the cavity in response to a user supplied force that acts radially on the flexible outer wall;

a controller coupled to the valve, wherein the controller is configured to open and close the valve to regulate a flow of air into and out of the cavity and to maintain a constant pressure within the cavity when the user applies the radial user supplied force;

wherein the body is cylindrical and has a diameter between 35 mm and 45 mm, and has a height between 115 mm and 125 mm, wherein the body is configured to be gripped by a hand of the user.

* * * * *